United States Patent [19]

Montgrain

[11] 4,277,280

[45] Jul. 7, 1981

[54] APPARATUS AND METHOD FOR REMOVAL OF ALKALI AND ALKALINE EARTH METALS FROM MOLTEN ALUMINIUM

[75] Inventor: Luc Montgrain, Arvida, Canada

[73] Assignee: Alcan Research and Development Limited, Montreal, Canada

[21] Appl. No.: 66,379

[22] Filed: Aug. 14, 1979

[30] Foreign Application Priority Data

Aug. 23, 1978 [GB] United Kingdom ..... 34381/78

[51] Int. Cl.[3] ..... C22B 9/02

[52] U.S. Cl. ..... 75/68 R; 75/93 AC; 266/227

[58] Field of Search ..... 75/68 R, 93 AC; 266/227

[56] References Cited

U.S. PATENT DOCUMENTS

| | | | |
|---|---|---|---|
| 3,010,712 | 11/1961 | Judge et al. | 75/68 R |
| 3,528,801 | 9/1970 | Bylund et al. | 75/257 |
| 3,907,962 | 9/1975 | Ogiso | 75/68 R |
| 3,917,242 | 11/1975 | Bass | 75/68 R |

*Primary Examiner*—M. J. Andrews

*Attorney, Agent, or Firm*—Cooper, Dunham, Clark, Griffin & Moran

[57] ABSTRACT

For the removal of alkali metal and alkaline earth metal contaminants molten aluminium (including Mg-free aluminium alloys), is passed through an active bed of particles of material containing aluminium fluoride, maintained continuously immersed in molten aluminium. Alkali metal and alkaline earth metal contaminants react and may release insoluble molten reaction products. In order to avoid plugging of the active bed and achieve removal of molten reaction products the molten metal is preferably passed upwardly successively through an inactive filter layer, an active bed layer and a further inactive filter layer.

19 Claims, 1 Drawing Figure

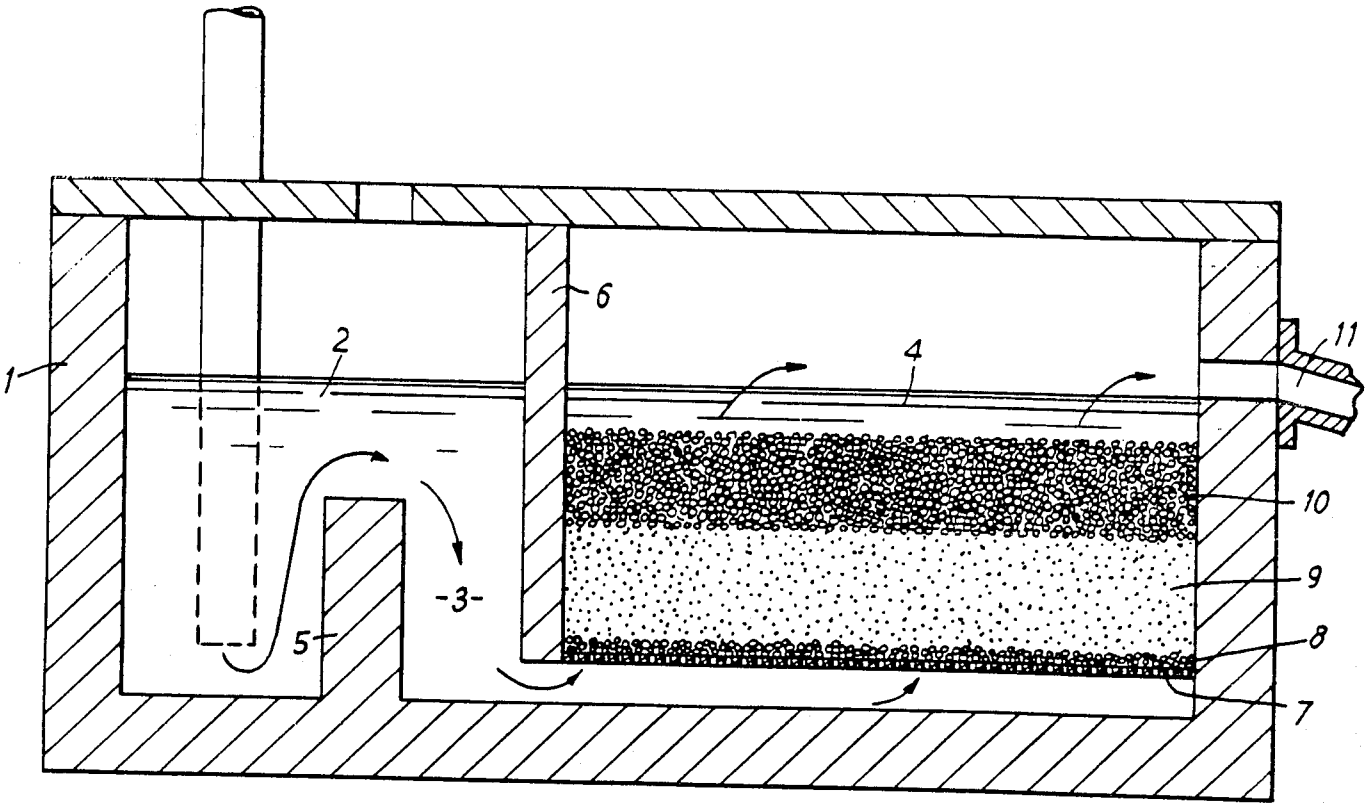
11
10
9
8
7
4
6
-3-
2
5
1

APPARATUS AND METHOD FOR REMOVAL OF ALKALI AND ALKALINE EARTH METALS FROM MOLTEN ALUMINIUM

The present invention relates to the removal of small quantities of alkali metals and alkaline earth metals from molten aluminium.

Molten aluminium withdrawn from electrolytic reduction cells inevitably contains minor amounts of alkali metals, such as lithium and sodium, and alkaline earth metals, such as magnesium and calcium. These impurities are derived from the alumina charged to the electrolytic reduction cell, the fluoride salts forming the electrolyte of the reduction cell, and the carbonaceous material comprising the consumable anodes of the cell. Lithium in particular may derive from lithium compounds deliberately added to the cell electrolyte to improve current efficiency and hence the economics of the smelting process. Lithium is also added to reduce the fluoride emission from the cells.

The presence of sodium and calcium in concentrations as low as 2 ppm is undesirable in primary aluminium from the reduction cell because the presence of these metals in even very minor amounts can result in hot "shortness" and edge cracking during hot rolling of aluminium alloys containing magnesium. Since a large proportion of primary aluminium is used to produce magnesium-containing alloys the presence of sodium and calcium at even very low impurity levels should be avoided.

The presence of magnesium in primary aluminium is also undesirable because it has a detrimental effect on electrical conductivity where the primary aluminium is employed in the production of conductor cables and similar products. The presence of magnesium is also undesirable when the aluminium is to be rolled down to a strip or foil product, which may be coated with an organic lacquer because of the deleterious effect of magnesium on lacquer adhesion.

The presence of lithium in concentrations exceeding about 1 ppm can also lead to difficulties in the casting apparatus for converting the molten aluminium into cast products. Lithium increases the rate of oxidation of molten aluminium, and the oxide so formed tends to clog dip tubes, floats and nose pieces and progressively builds up thick surface films in troughs, tundishes and basins. Its presence leads to significantly increased melt losses, particularly in the production of magnesium-containing alloys. It is also undesirable as leading to a decrease in electrical conductivity when the aluminium is employed in the production of electrical conductors.

It has already been proposed in U.S. Pat. No. 3,305,351 to pass aluminium through a bed of solid aluminium fluoride particles for the purposes of removing lithium, sodium and magnesium from the molten metal. The apparent intention of the treatment is to react the alkali metal (Li, Na or Mg) with the aluminium fluoride so that the alkali metal becomes converted to the corresponding alkali metal fluoride which combines with aluminium fluoride to form a fluoaluminate.

In the described process the molten aluminium is passed downwardly through a bed of aluminium fluoride particles supported on a perforated screen. These particles typically had a size in the range of 6–20 mm. The system employed in U.S. Pat. No. 3,305,351 is open to certain objections which are not immediately apparent. In the first place molten aluminium drawn from a reduction cell almost inevitably contains some molten electrolyte from the bath and frequently also contains solid sludge particles which sink into the molten metal layer at the bottom of the reduction cell. These materials, when carried over with the molten metal, tend to accumulate on the upstream side of the bed of aluminium fluoride particles, leading to premature "plugging" of the bed, and hindering flow of molten aluminium through it. Replacement of the bed then becomes necessary. A further difficulty is that some of the products of the reaction between the alkali metal (and alkaline earth metal) impurities with the aluminium fluoride particles are likely to be molten at the temperature of the metal undergoing treatment, with the result that the particles of the bed can become agglomerated. A further difficulty is that the remaining molten reaction products which are in fact carried through the bed with the molten metal, become re-converted to the respective metals in the case of Na, Ca and Li when the aluminium is subsequently alloyed with magnesium.

Further problems are encountered with the operation of the process as described in U.S. Pat. No. 3,305,351 when the supply of molten aluminium for treatment is interrupted. Interruption in supply of molten metal may result in exposure of the very hot bed of aluminium fluoride to the atmosphere. This results in some hydrolysis of the aluminium fluoride by reaction with atmospheric moisture, resulting in contamination of the working environment around the apparatus by released hydrogen fluoride. There is simultaneous reduction in the activity of the aluminium fluoride bed by reason of the formation of alumina on the surface of the aluminium fluoride particles. On exposure to the atmosphere, aluminium fluoride will catalyse the exothermic oxidation of any aluminium remaining in the bed after draining. This has the effects of (a) increasing the temperature of the bed which in turn increases the rate of hydrolysis, (b) increasing the alumina content of the bed hence further decreasing its activity, and again tending to plug the bed and hinder flow of aluminium through it. This also has the obvious effect of increasing the melt loss.

It is an object of the present invention to provide an improved form of apparatus and an improved method of operation for the removal of alkali metal and alkaline earth metal contamination of molten aluminium, including aluminium alloys. The term "aluminium" is employed hereinafter to include all aluminium alloys, except alloys which have a magnesium content of more than contaminant quantity, i.e. more than 0.1%.

According to a first feature of the invention an apparatus and method for the removal of alkali metal and alkaline earth metal impurities from molten aluminium metal is arranged so that a bed of aluminium fluoride particles is constantly maintained submerged in a body of molten aluminium, irrespective of whether there is positive flow or zero flow of aluminium through the bed of aluminium fluoride particles. Preferably the molten aluminium is passed through a primary bed of filter particles arranged on the upstream side of the bed of reactive aluminium fluoride particles so as to remove solid or molten non-metallic contaminants before entry into the bed of aluminium fluoride particles. In addition to its function of removing such non-metallic contaminants, this primary bed serves the purpose of making the flow of molten aluminium more even through the bed of aluminium fluoride particles and thereby rendering it more effective in reacting with alkali metal and alkaline earth metal contaminants present in the molten aluminium. The particles forming the filter layer on the upstream side of the bed of aluminium fluoride particles should be inert to molten aluminium and of such material as to be wetted by the molten electrolyte from the reduction cell. Examples of material which are suitable for the present purpose are tabular alumina, dead-burned magnesite, silicon carbide and refractory aluminosilicate containing no free silica, such as mullite and kyanite. In addition to providing a filter layer on the upstream side of the reactive bed of aluminium fluoride particles, it is preferred to provide a similar layer of particles on the downstream side for the purpose of trapping and collecting the molten alkali metal fluoaluminate reaction products which are washed through the active bed of aluminium fluoride particles. Thus there is preferably a filter layer of refractory particles both above and below the active bed of aluminium fluoride particles. It is preferable that both these layers of particles should be formed of the same material for reasons of convenience and ease of recycling. It is therefore desirable that the refractory particles should be more dense than molten aluminium to avoid the necessity of placing a restraining screen above the upper of these layers. This is irrespective of whether the stream of molten metal is passed upwardly or downwardly through the bed of aluminium fluoride particles. It is however preferred that the apparatus shall be of the underflow type with the stream of molten metal passed upwardly through the bed of aluminium fluoride particles. In operating this system the molten bath electrolyte from the electrolytic reduction cell tends to be collected in the upstream layer of filter particles which are supported on a screen underneath the reactive bed of aluminium fluoride particles. After passage through the filter layer the molten aluminium enters the bed of reactive aluminium fluoride particles, where its alkali metal and alkaline earth metal contaminants react with the aluminium fluoride to form fluoaluminates which may pass through a molten stage during their formation at the temperature of treatment. Since these liquid fluoaluminates are less dense than aluminium they tend to be washed through the bed of aluminium fluoride particles by the rapidly flowing molten metal and are caught by the second filter layer on the downstream side of the aluminium fluoride particle bed. This is the preferred arrangement since it follows that the reactivity of the aluminium fluoride particle bed remains unaffected by the fluoaluminate reaction products for a longer period than in a system where the passage of the molten metal is downward through the aluminium fluoride particle bed, since in the latter arrangement the molten fluoaluminate reaction products have a greater tendency to be trapped in the active fluoride particle bed itself, tending to plug up the interstices of the bed and to reduce the activity of the fluoride particles.

It is preferred to pass the stream of molten aluminium upwardly through the successive layers composed of non-reactive refractory filter particles, reactive aluminium fluoride particles and succeeding layer of non-reactive refractory filter particles. Substantial advantages are achieved as compared with the prior U.S. Pat. No. 3,305,351 so long as the particle layers are maintained submerged in molten aluminium irrespective of whether the metal is flowing or is static and irrespective of whether flowing upwardly or downwardly. While it has already been proposed in British Pat. No. 1,148,344 to pass molten aluminium downwardly through a bed composed of granules of calcium and/or magnesium fluoride, which is maintained permanently submerged in the molten metal, for the purpose of flitering out and removing solid and/or gaseous inclusions, the treatment does not appear to have been employed to remove alkali metal or alkaline earth metal contaminants dissolved in the molten aluminium. In the method of the present invention upward flow of metal is preferred to downward flow, which requires thick layers of tabular alumina on both sides of the active bed. In the method of the present invention when downward flow is employed the upper filter layer on the upstream side has to restrain the tendency of some of the aluminium fluoride particles to float, besides protecting the material from the combustion products of the preheating device, whilst the lower layer on the downstream side must be sufficiently thick to serve to entrap and retain the reaction products. By comparison, in a system using upwardly flowing metal, only the upper layer (on the downstream side) needs to be thick. Therefore, the latter system is easier to preheat uniformly because there is less solid material. The layers are also cheaper for the same reason.

In the above description of the process of the present invention the bed of reactive particles has been considered only in terms of aluminium fluoride. However the bed of reactive particles may be composed wholly or in part of alkali metal fluoaluminates which are solid at the temperature of the molten metal. Thus where the treatment is aimed primarily at removal of lithium, magnesium and calcium, the bed of reactive particles may be formed of sodium cryolite or lithium-free reduction cell electrolyte having a low ratio of NaF; $AlF_3$, i.e. containing $AlF_3$ in excess of the stoichiometric requirements of $Na_3AlF_6$, provided the material is of a composition such that a major proportion remains solid at the temperature of treatment. This will normally be the case provided the above ratio remains within the range 1.3 to 1.5. The active fluoride salts may contain a proportion of inert material such as aluminium oxide. Such material is often present in commercial purity aluminium fluoride in proportions of for example 1–10%. The presence of up to 50% by weight of inert material in the active layer does not adversely affect the operation of the process. In fact, some benefit may be derived from the mechanical support which such inert material may give the fluoride salts as they are consumed by the reaction by providing a rigid supporting skeleton. All the above materials may be considered as $AlF_3$-containing materials for the purpose of the present invention.

One form of apparatus for putting the present invention into effect is diagrammatically illustrated in the accompanying drawing.

The apparatus comprises a steel shell 1 lined with refractory. The metal for treatment is introduced into an entry chamber 2, arranged to receive molten metal from a ladle by syphon transfer, in which a large part of entrained sludge solids sink to the bottom and are trapped. The metal then passes over a weir 5 to enter a passage 3, through which it flows downwardly. Some bath electrolyte tends to remain as a supernatant layer at the top of the entry chamber 2.

The molten aluminium, which flows downwardly through the passage 3, passes under a baffle 6 into a space below a support grid 7, formed of refractory concrete bars or other material which is not subject to attack by molten aluminium. On the grid 7 is supported a first layer of refractory particles, which in the present example is formed of a layer 8 of tabular alumina in the form of balls of approximately 18 mm diameter. The layer 8 typically has a depth of 25–50 mm and entraps by adsorption any liquid and solid particles still present in the metal passing under the baffle 6. The layer of relatively coarse tabular alumina balls also has an effect of distributing metal flow into the layer 9 of finer aluminium fluoride particles supported on the layer 8. Granulometry and shape of particles in both the active and refractory layers of the bed should be such as to ensure an adequate efficiency of contact between the flowing metal and the active particles to ensure an acceptable degree of removal of alkali or alkaline earth metal. Efficiency of contact is the result of the combined effect of:

(a) residence time
(b) interfacial area of contact
(c) non-laminar flow

The combination of conditions for an underpour system (upwardly flowing metal) is as follows:

| Inner Preferred Limits: | Outer Preferred Limits: |
|---|---|
| Mesh size of active particles 100% 5–30 mm | 90% 5–30 mm |
| Thickness of active bed 125–225 mm | 50–600 mm |
| Cross-sectional area of bed 1–2.5 sq.m | 0.1–3 sq.m |
| Mesh size of refractory particles 100% 20–40 mm | 90% 15–50 |
| Thickness of refractory bed (upstream layer) 25–50 mm | 0–100 mm |
| Thickness of refractory bed (downstream layer) 125–225 mm | 50–400 mm |

Examples of suitable particle shape of both active and refractory particles are:

(i) uniformly-sized spheres
(ii) approximately equi-axed chunks
(iii) small rings like Raschig rings Where metal tapped from cells is clean and free from entrained electrolyte, and where the grid or screen on the upstream side of the active bed can serve to distribute the molten metal, the upstream layer of refractory particles can be dispensed with.

The depth of these layers may be adjusted above and below these latter limits in dependence upon the metal flow rate through the layers and the percentage of removal of alkali metal contaminants required. All the latter parameters are interdependent such that a change in any one implies a change in them all. For example, use of a coarser grade of particle would necessitate a thicker bed.

As already explained the reaction products resulting from the contact of the contaminated aluminium with the aluminium fluoride particles may be molten at the temperature of the aluminium under treatment and will in most instances be less dense than the molten aluminium so that these reaction products tend to be washed through the layer of aluminium fluoride particles by the upward flow of metal. Consequently effect of said reaction products in reducing the activity of the aluminium fluoride particles and in plugging up the interstices in the bed of such particles is substantially reduced. However it is necessary to provide an upper layer 10 of tabular alumina balls or similar refractory particles to trap the molten reaction products washed out of the layer 9. The alumina balls in the upper layer 10 preferably have the same size range as the balls of the lower layer 8.

This upper layer of alumina balls, in addition to performing a filtering function, also acts to hold down the layer 9 of aluminium fluoride particles and thus prevent the fluidisation of these particles, which are both relatively small in size and of relatively low specific gravity in relation to molten aluminium. After passage through the upper layer 10 of alumina balls the molten metal leaves the apparatus through an exit trough 11 which is arranged to be at a level above the layer 10 so that the whole of the particle bed is maintained continuously submerged in molten aluminium irrespective of whether there is a metallostatic head of metal in the syphon chamber 2 to drive a stream of molten metal through the particle layers 8, 9 and 10. A feature of the process of the invention is that the materials of the bed can be readily recycled. This is achieved by firstly introducing spent bed material to a rotating drum type of mill. No extra grinding media are required as this purpose is served by the granular refractory material (e.g. tubular alumina) from the inert layers. The spent active material is friable and readily separated after grinding from the still lumpy inert material by a simple sieving operation, e.g. on a $\frac{3}{4}''$ mesh sieve. Such active material typically contains about 5% of lithium fluoride which can be recovered by recycling to reduction cells. The recovered refractory material can be re-used directly in the apparatus of the invention.

During the intervals between operational use, the apparatus is maintained at working temperature by one or more gas or oil burners or electrical heating elements normally introduced from above. The same burners are used to preheat a new bed from cold at the commencement of the campaign. The preferred temperature of the bed at the commencement when metal is first poured into the apparatus is 900° C. at the top of the bed. Because there is a temperature gradient through the bed this corresponds to a temperature of approximately 300° C. at the bottom of the bed after approximately 24 hours preheating. At this stage the equipment is ready for use. In order to retard heat losses, an insulating lid is provided to partially cover the apparatus, sufficient clearance being allowed to enable complete removal of burner exhaust, to prevent moisture build-up from products of combustion inside the apparatus. Part of the cover can be removed to permit access to skim the surface of the molten contents of the entry chamber of the apparatus.

The described apparatus has been employed for the treatment of a large tonnage of molten aluminium drawn from an electrolytic reduction cell of which the following is typical.

Bed area 2 $m^2$
Flowrate 30 $g/mm^2/hr$
Life 700 tonnes
Metal throughput 200 tonnes/day

| | | |
|---|---|---|
| Thickness of bed (underpour) | Upstream layer | 35 mm |
| | Active layer | 180 mm |
| | Downstream layer | 150 mm |

| Average Before Filtration | Average After Filtration | Average Removal |
|---|---|---|
| Lithium: 22 ppm | 2.2 ppm | 90% |
| Sodium: 35 ppm | 3.5 ppm | 90% |
| Calcium: 4 ppm | 1 ppm | 75% |

Average content of transfer vessel: 3.5 tonnes of metal
Average time of treatment of one transfer vessel: 3 minutes and 45 seconds -continued

| |
|---|
| Grade of $AlF_3$: 90% $AlF_3$ - 10% $Al_2O_3$ |
| Granulometry of $AlF_3$: 100% 5-20 mm |
| Granulometry of tabular alumina: plus 20 mm mesh. |

In a further test made under conditions described below in which magnesium was present, the following results were obtained:

| Average Before Filtration | Average After Filtration | Average Removal |
|---|---|---|
| Magnesium: 64.2 ppm | 10 ppm | 84% |
| Conditions of Test: | | |
| Bed area: 1.3 $m^2$ | | |
| Flowrate: 20 $g/mm^2/hr$ | | |
| Bed life: 112 tonnes | | |
| Metal throughput: 56 tonnes/day | | |
| Bed thickness: 150 mm (active layer thickness) | | |
| 150 mm (tabular alumina downstream) | | |
| 0 mm (tabular alumina upstream) | | |
| Average content of transfer vessel: 3.5 tonnes of metal | | |
| Average times for treatment of one transfer vessel: 7 minutes | | |
| (grades and granulometry of materials same as previous example). | | |

Although the Li and Na levels of the filtered metal in the first test were still somewhat above the respective maxima of 1 ppm and 2 ppm, above which they can cause difficulties in casting the metal, the Li and Na contents of the Al metal underwent further reduction as a result of selective oxidation in cascading the treated metal into a holding furnace and holding the metal in the furnace before casting. The primary metal ingots cast therefrom had Li and Na contents below the above prescribed maxima. If it were desired for the treated metal to be supplied direct to a casting station without any intermediate residence in a holding furnace, the desired low levels of Li and Na could be achieved by increase of the contact time of the molten Al metal with the active $AlF_3$ or cryolite layer. That would entail either a reduction in the flow rate of molten metal and/or an increase in the thickness of the active layer and/or increasing the surface area of a given volume of active material.

In the foregoing tests the approximate residence times of the molten metal within the reactive beds were respectively 12 secs and 15 secs. In order to obtain the advantages of the invention the residence time of the molten aluminium metal should be in the range of 6 secs to 120 secs, more preferably in the range of 8 to 30 secs.

The method and apparatus of the present invention may be employed both for the removal of Li and other alkali and alkaline earth metals and of molten electrolyte inclusions from primary metal from electrolytic reduction. It may also be employed for the removal of alkali and alkaline earth contamination from molten secondary metal and aluminium alloys, which do not contain definite Mg additions: higher levels of Mg would lead to premature failure of the active layer by reaction of $AlF_3$ with Mg.

I claim:

1. A method for treating molten Al metal to reduce its contents of alkali metal and alkaline earth metal impurities which comprises maintaining a bed of reactive particulate aluminium fluoride-containing material submerged in a body of molten aluminium, said aluminium fluoride-containing material having a melting point above the temperature of said molten aluminium and being maintained submerged irrespective of positive flow or zero flow of molten aluminium through said bed of particulate material, passing a stream of molten aluminium upwardly through said bed for reaction of its alkali metal and alkaline earth metal content with said reactive aluminium fluoride-containing material and passing the stream of molten aluminium, emerging from said bed, through a downstream layer of particulate refractory filter material, said layer of particulate refractory material being inert to molten aluminium and wettable by fluoaluminates formed by reaction of alkali metal and alkaline earth metal impurities in said molten aluminium with said reactive aluminium fluoride-containing material.

2. A method according to claim 1 further including passage the stream of aluminium metal initially through a particulate layer of refractory filter material located upstream from said bed of reactive material, said refractory material being inert to molten aluminium and wettable by molten fluoride salts.

3. A method according to claim 1 in which said reactive aluminium fluoride-containing material includes a proportion of alkali metal fluoaluminate which remains solid at the temperature of the molten aluminium.

4. A method according to claim 1 in which said downstream particulate refractory layer is composed of tabular alumina.

5. A method according to claim 4 in which said tabular alumina is in the form of balls in a size range of 15–50 mm.

6. A method according to claim 1 in which said downstream particulate refractory layer is composed of particles in a mesh size range of 20–40 mm.

7. A method according to claim 4 in which said tabular alumina is in the form of balls in a size range of 15–50 mm.

8. A method according to claim 2 in which said upstream particulate refractory layer is composed of particles in a mesh size range of 20–40 mm.

9. A method according to claim 1 in which the thickness of said bed of reactive material is in the range of 50–600 mm and 90% of the particles of said reactive material are in a mesh size range of 5–30 mm.

10. A method according to claim 1 in which the thickness of said bed of reactive material is in the range of 125–225 mm.

11. A method according to claim 1 in which the thickness of said downstream layer of refractory filter material is in the range of 50–400 mm.

12. A method according to claim 1 in which the thickness of said downstream layer of refractory filter material is in the range of 125–225 mm.

13. A method according to claim 1 in which the molten aluminium is passed through the reactive bed at such rate as to achieve a residence time of 6 to 120 secs in such bed.

14. Apparatus for treating molten Al metal to reduce its content of alkali metal and alkaline earth metal impurities comprising an enclosed casing, a filter chamber within said casing, a molten metal exit in the upper part of said filter chamber, a molten metal supply to said casing for leading molten metal into the bottom of said filter chamber beneath a filter support, on which are supported a layer of reactive aluminium fluoride-containing particles for reaction with alkali metal and alkaline earth metals in a molten aluminium stream and an upper layer of refractory filter material particles, inert to molten Al metal said layers being located beneath the level of said molten metal exit whereby to remain submerged in molten metal when supply of molten metal to said chamber is interrupted.

15. Apparatus according to claim 14 further including a metal entry chamber in said casing to collect sludge from molten metal introduced into said entry chamber, an overflow weir and a downwardly directed passage leading to the space between said filter support and the floor of the casing.

16. Apparatus according to claim 14 further including a lower layer of refractory filter material particles, inert to molten aluminium, between said support and said reactive layer.

17. Apparatus according to claim 16 in which said bottom layer of refractory filter particles is thin in relation to said upper layer of refractory filter particles.

18. Apparatus according to claim 14 in which said upper layer of refractory filter particles is composed of material more dense than molten aluminium.

19. Apparatus according to claim 16 in which said refractory filter layers are formed of tabular alumina.

* * * * *